US006431526B1

(12) United States Patent
Guerra et al.

(10) Patent No.: US 6,431,526 B1
(45) Date of Patent: Aug. 13, 2002

(54) RAILING COMPONENTS AND METHODS OF MAKING RAILINGS

(75) Inventors: Gina Guerra, Hamilton; Jeffrey George Witt, Waterdown; Timothy Lim, Burlington; Vernon Jim Casey, Hamilton, all of (CA)

(73) Assignee: Dofasco Inc., Hamilton (CA)

( * ) Notice: Subject to any disclaimer, the term of this patent is extended or adjusted under 35 U.S.C. 154(b) by 0 days.

(21) Appl. No.: 09/302,376

(22) Filed: Apr. 30, 1999

Related U.S. Application Data

(60) Provisional application No. 60/083,991, filed on May 1, 1998.

(51) Int. Cl.[7] ..... E04H 17/14

(52) U.S. Cl. ..... 256/59; 256/19; 256/21; 256/DIG. 5

(58) Field of Search ..... 256/59, 1, 19, 256/65, 66, DIG. 5, 21, 22

(56) References Cited

U.S. PATENT DOCUMENTS

| | | | | | |
|---|---|---|---|---|---|
| 55,874 | A | * | 6/1866 | King | 256/22 |
| 3,698,691 | A | * | 10/1972 | Brown | 256/65 X |
| 3,710,828 | A | * | 1/1973 | Ziemek et al. | 138/171 |
| 3,924,834 | A | | 12/1975 | Young | |
| 3,963,218 | A | * | 6/1976 | Glaesener | 265/1 |
| 4,074,893 | A | * | 2/1978 | Coltrin | 256/65 X |
| 4,103,412 | A | * | 8/1978 | Krieger | 29/460 |
| 4,344,604 | A | | 8/1982 | Basey | |
| 4,352,485 | A | | 10/1982 | Basey | |
| 4,403,767 | A | | 9/1983 | Basey | |
| 4,461,461 | A | * | 7/1984 | Caron | 256/19 |
| 4,533,121 | A | | 8/1985 | Basey | |
| 4,600,044 | A | | 7/1986 | Gray | |
| 4,682,762 | A | * | 7/1987 | Lekavich | 256/65 |
| 4,854,549 | A | | 8/1989 | Roberts et al. | |
| 5,056,283 | A | | 10/1991 | Sapinski | |
| 5,062,732 | A | | 11/1991 | Ballerstein | |
| 5,078,367 | A | * | 1/1992 | Simpson et al. | 256/19 X |
| 5,124,186 | A | * | 6/1992 | Wycech | 428/35.8 |
| 5,149,060 | A | * | 9/1992 | Boes | 256/21 |
| 5,240,230 | A | * | 8/1993 | Dougherty | 256/65 X |
| 5,261,201 | A | | 11/1993 | Smith | |
| 5,312,089 | A | * | 5/1994 | Venegas, Jr. | 256/65 |
| 5,354,037 | A | * | 10/1994 | Venegas, Jr. | 256/59 |
| D373,833 | S | * | 9/1996 | Lapp, Jr. | 256/19 X |
| 5,566,927 | A | * | 10/1996 | Venegas, Jr. | 256/59 |
| 5,575,526 | A | * | 11/1996 | Wycech | 296/205 |
| 5,601,279 | A | * | 2/1997 | Schwartz et al. | 256/66 |
| 5,613,664 | A | * | 3/1997 | Svalbe | 256/19 |
| 5,626,331 | A | * | 5/1997 | Erwin | 256/59 |
| 5,660,005 | A | * | 8/1997 | Tacoma | 52/93.2 |
| 5,755,431 | A | * | 5/1998 | Williams | 256/19 |
| 5,876,021 | A | * | 3/1999 | Spence et al. | 256/19 |
| 5,884,960 | A | * | 3/1999 | Wycech | 296/146.6 |
| 5,899,442 | A | * | 5/1999 | Meglino et al. | 256/19 X |
| 6,017,019 | A | * | 1/2000 | Erwin | 256/65 |
| 6,126,148 | A | * | 10/2000 | Lesenskyj | 256/65 |

FOREIGN PATENT DOCUMENTS

| | | | | |
|---|---|---|---|---|
| DE | 2109105 | | 9/1972 | |
| DE | 2355330 | | 5/1974 | |
| DE | 2259211 | | 6/1974 | |
| DE | 3404276 | * | 8/1985 | 256/65 |
| FR | 2729415 | | 7/1996 | |
| JP | 405133064 | * | 5/1993 | 256/59 |
| JP | 406173504 | * | 6/1994 | 256/59 |

* cited by examiner

*Primary Examiner*—Lynne H. Browne
*Assistant Examiner*—David E. Bochna
(74) *Attorney, Agent, or Firm*—John R.S. Orange; Orange & Chari

(57) ABSTRACT le;.5qA railing component has a tubular metal body with a non-uniform cross section. The body is formed by hydro-forming and has a coating applied to the exterior. A pattern is applied to the coating to simulate a wood grain. The interior of the tubular body is filled with foam and plugs are provided at opposite ends for connection to other railing components.

32 Claims, 9 Drawing Sheets

RAILING COMPONENTS AND METHODS OF MAKING RAILINGS

RELATED APPLICATIONS

This application claims the benefit of provisional application No. 60/083,991 filed May 1, 1998.

FIELD OF INVENTION

This invention relates to components for use in a railing system such as spindles, rails and posts.

BACKGROUND OF INVENTION

Railing systems as used to protect elevated locations and staircases, typically include upper and lower rails extending between newel posts with vertical spindles extending between the rails. These systems are assembled from individual components so that they may be custom fitted to the particular location. Some of the components are typically of non-uniform cross section and may be ornamented for aesthetic appeal.

Dimensional lumber is the most widely used material in North America for staircase components and railing systems. High value wood products such as oak, mahogany, cherry and walnut are in great demand for staircase components for their durability, warmth and richness. It takes approximately 50 years for a hardwood tree to grow in order to harvest it for this purpose and prices of these species are affected accordingly. Increasing environmental awareness is creating due concern about the depletion of these rare species of hardwoods. Pine, birch and poplar are widely used especially for the spindle component as these trees grow faster, can be harvested earlier and can be mass produced more economically due to lower wood prices. However, the variability of the wood and the grain structure make it suitable for painting rather than staining and therefore less desirable.

Metal has been used for railing components but its inherent weight has limited its use to uniform small cross sections, typically bars, that have limited aesthetic appeal. Larger and variable cross sections have not been practical from a cost and structural perspective. In some cases, cast posts have been used but their cost and weight are prohibitive.

Wrought iron is commonly used for ornamental purposes on exterior stairs, particularly in commercial environments. However the cost is prohibitive for interior residential use and the weight is considerably greater than traditional wood railings.

It is therefore an object of the present invention to obviate or mitigate the above disadvantages.

In general terms, the present invention provides a railing component comprising a tubular metal wall extending between opposite ends and having a substantially uniform wall thickness, said component varying in cross section between said opposite ends.

Preferably, a foam core is provided within the tubular metal wall and connectors are provided at opposite ends to facilitate connection.

According to a further aspect a method of manufacturing a railing component having a tubular metal body of varying cross section comprises the steps of inserting a tube into a die having an interior surface conforming to the exterior profile of said railing component, applying internal pressure to said tube to cause said tube to conform to said die and removing said tube from said die.

Embodiments of the invention will now be described by way of example only with reference to the accompanying drawings in which.

Figure 1:
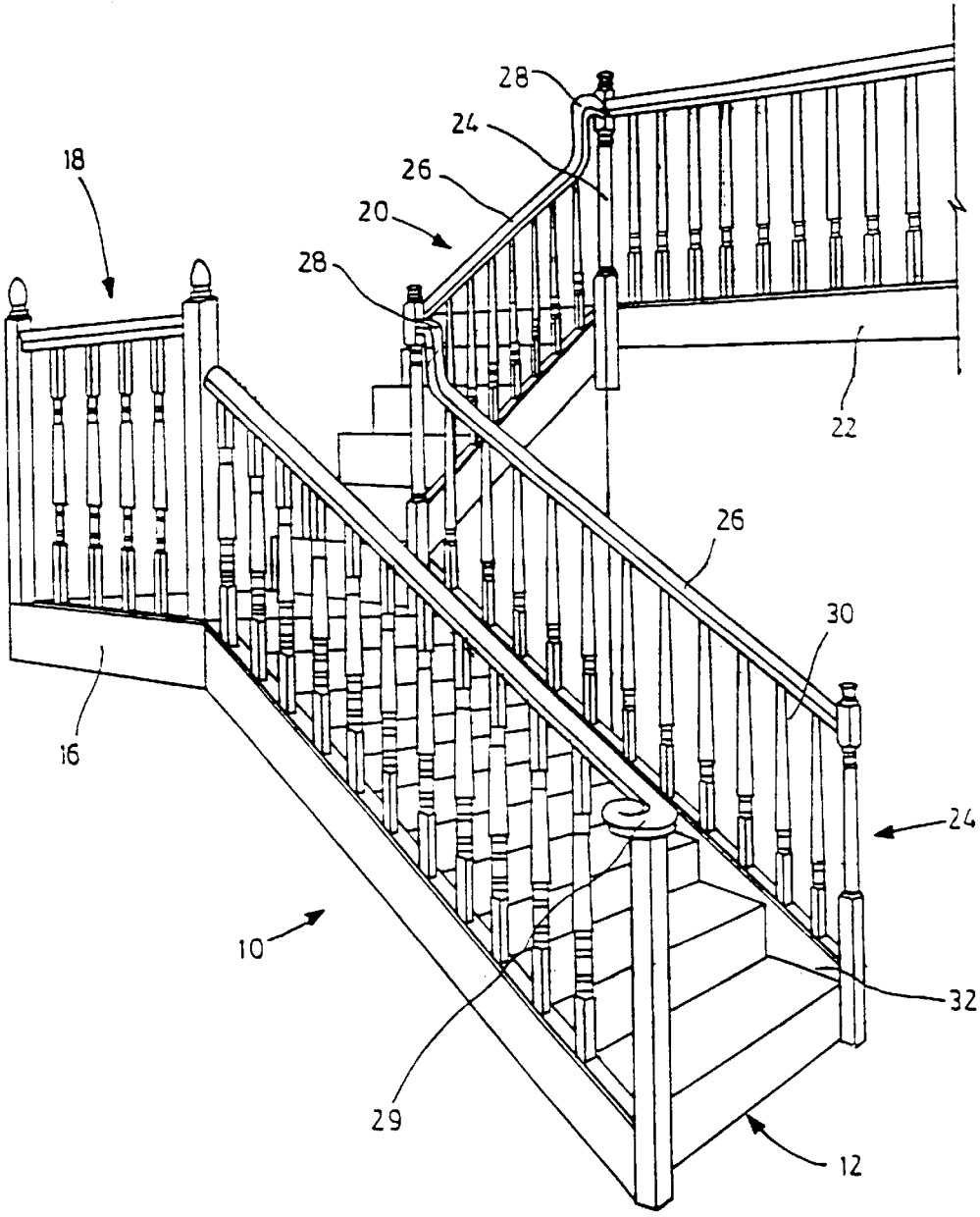
FIG. 1 is a perspective view of a typical stair system.

Referring therefore to FIG. 1, a staircase generally indicated 10 has a pair of flights of stairs 12, 14 interconnected by a landing 16. Railings 18, 20 extend on opposite sides of the stair flights 12, 14 and continue across an upper landing 22.

Each of the railings 18, 20 includes spaced newel posts 24 with handrails or banisters 26 extending between the newel posts 24. A gooseneck 28 is positioned adjacent to the newel post to elevate the banister 26 adjacent to the final step of each flight of stairs and a volute 29 located at the lower end of the railing 18.

Spindles 30 extend between each of the banisters 26 and stringers 32 running alongside the flight of stairs 12,14. The spindles 30 are connected at opposite ends to the banister 26 and stringer 32 so as to withstand the lateral loads placed on them.

Figure 2:
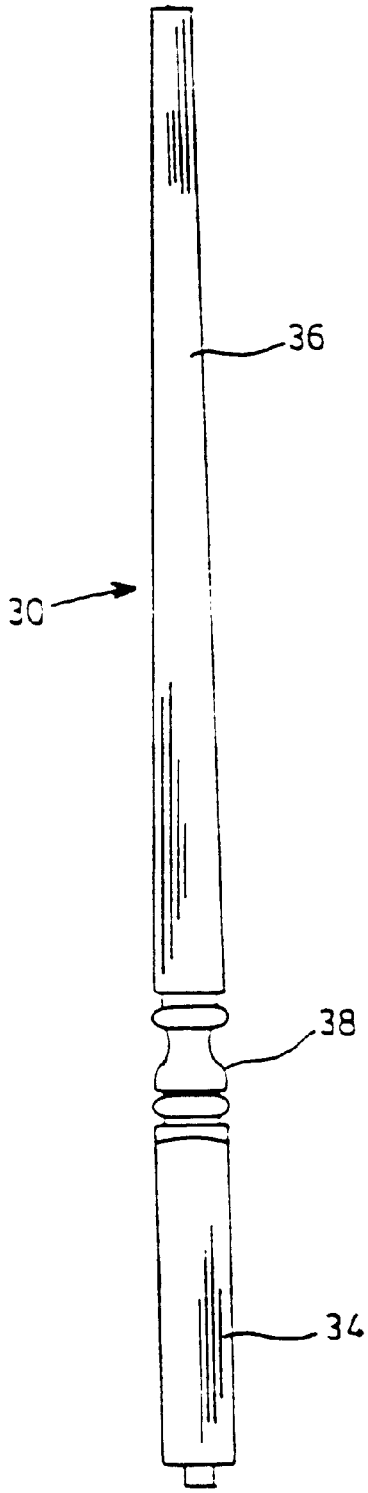
FIG. 2 is a perspective view of a spindle used in the stair of FIG. 1.

As may be seen in FIG. 2, each of the spindles 30 is of non-uniform i.e. varying, cross section along its length and is shaped to provide an ornamental outer surface. In the particular embodiment illustrated spindle 30 includes a base 34 of square cross section and a smoothly tapering upper portion 36. The base 34 and upper portion 36 are interconnected by a contoured central portion 38.

Figure 3:
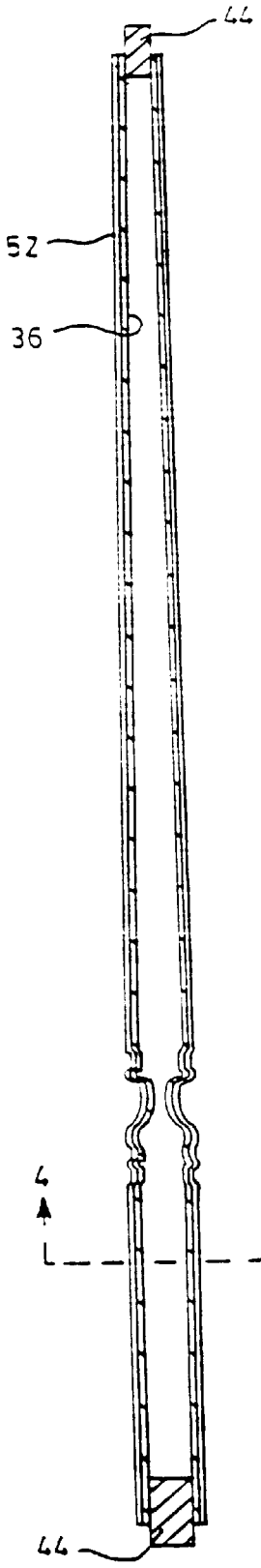
FIG. 3 is a longitudinal section of the spindle shown in FIG. 2.
Figure 4:
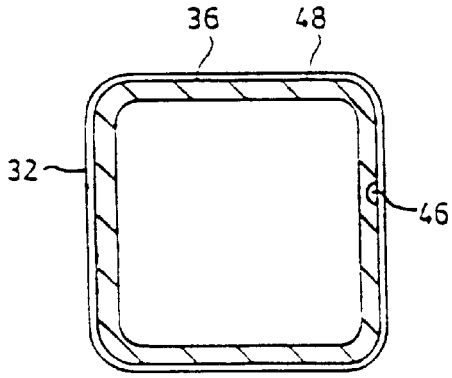
FIG. 4 is a view on the line IV—IV.

As can be seen from FIGS. 3 and 4, the spindle 30 has a tubular body 40 made of metal and a foam core 42. A connector 44 in the form of a wooden plug is disposed at each end of the spindle 30 with an interference fit in the tubular body 36. The plug 44 projects from the body slightly to allow trimming to final length in use and projects in to the body sufficiently for to provide a secure connection, typically 50 mn. The plug 44 may be secured by adhesive, particularly where the degree of taper provides limited engagement. The plug 44 may also be made of materials having similar characteristics, such as a composite material or a plastics material that can be nailed or screwed.

The corner region, as shown in FIG. 4, illustrates a fold line where a first planar facet 48 is joined to second planar facet 48.

In a typical application for a spindle the tubular body 40 has a wall thickness in the order of 0.5 mm to 2.0 mm (0.02 to 0.07 inches) and is of substantially uniform thickness along the length of the spindle. The spindle on average has a length of between 31 inches and 42 inches, typically in the order of 38 inches. The core 42 is provided to damp resonance in the tubular body and may be materials other than a foam. Where foam is used it may be of any suitable composition to foam in situ such as polystyrene or polyurethane and the plastic film may be a durable film such as a vinyl polymer coating.

Figure 5:
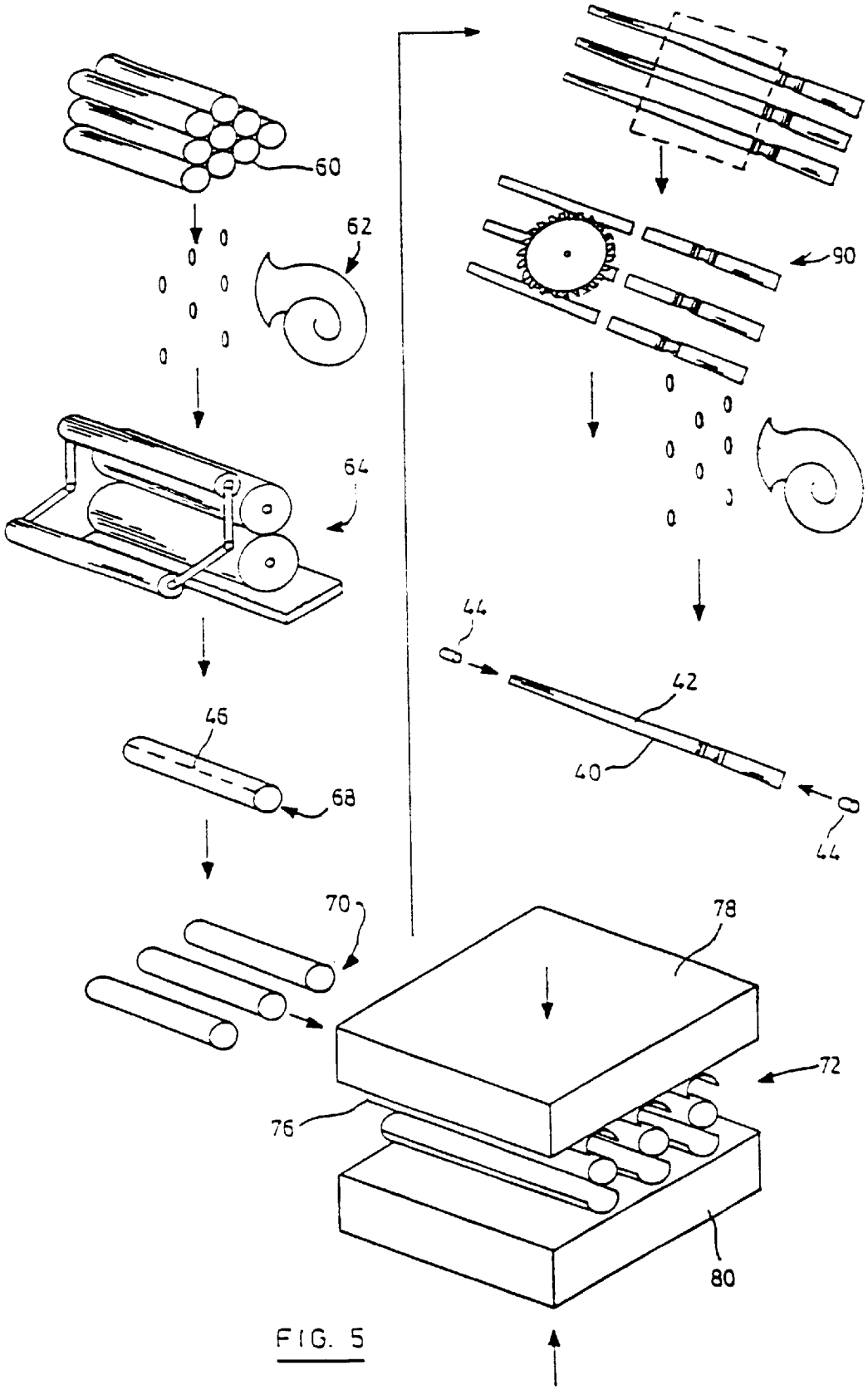
FIG. 5 is a schematic illustration of process of the steps of the manufacturing the spindles shown in FIG. 2.

The method of manufacturing the spindles 30 is shown in schematic form in FIG. 5. The tubular body 36 is formed from a metal tube 60 supplied from a hopper to washing and drying station 62. The washed and dried tubes 60 are passed to a coating station 64 where a vinyl polymer coating having a thickness in the order of 3 mil is applied to each of tubes 60. The coated tubes 60 so that a uniform smooth coating of vinyl polymer is adhered to the outer surface of the coated tubes.

The coated tubes 60 may then be passed through a second coating station to apply a forming lubricant which can be left wet or dried prior to hydroforming. In some cases the polymer coating itself may provide sufficient lubrication in the forming step and so obviate the need for the additional lubrication station.

Figure 6:
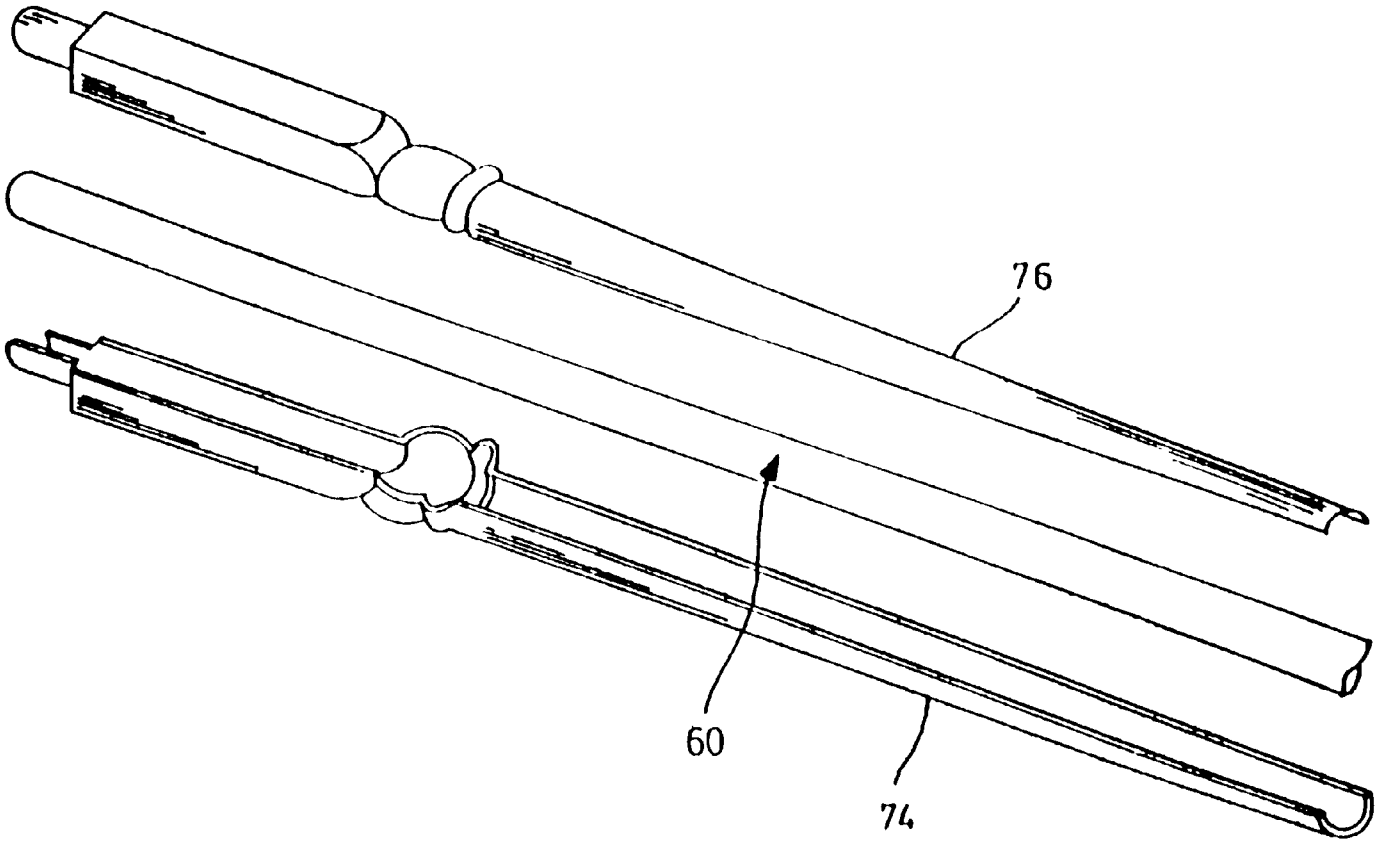
FIG. 6 is an enlarged view of a portion of the apparatus used in the process of FIG. 4.

The coated tubes 60 are then separated and orientated at an orientation station 68 such that the weld 46 on each of each of the tubes 60 is positioned in a predetermined orientation. The individual tubes 60 are then assembled into a load cell in a staging area 70 from which they are transferred by robot to hydroform press 72. The hydroforming press 72 is shown in more detail in FIG. 6 and includes upper and lower die halves 74, 76 secured to platens 78, 80 (FIG. 5). The die halves 74, 76 are configured to replicate the external shape of the spindle 36. Though not shown in FIG. 6 the die halves 74, 76 do in fact replicate a pair of spindles 36 end to end, that is the spindles are duplicated along their length so that a pair of spindles may be formed in one hydroforming operation. The configuration of the spindles with a tapered upper portion facilitates the conjoint forming by locating the majority of the tube deformation at the ends of the die cavity.

The tubes 60 are inserted between the die halves 74, 76 with the weld positioned in the die so as to relocate it at the mid point of one of the planar facets 48 of the base 34 of the spindle 30.

The tubes are connected to pressure fluid manifolds (not shown) and filled with fluid as the press platens 78, 80 close the die halves 74, 76.

With the press closed, the pressure of fluid in the tubes is increased to expand the tube in the die so that it assumes the shape of the die halves 74,76. Once the expansion has been completed, the fluid is purged and the formed tubes 60 transferred to a trimming station 90 where the tubes are separated into individual spindles. The spindles 30 are then cleaned and dried at cleaning station 92.

After cleaning and drying, a wooden plug 44 is inserted into one end of the spindle 30 and foam injected into the opposite end. After the requisite amount of foam has been inserted the second plug 44 is placed in the opposite end and the spindle sealed.

It will be apparent that the shape of the spindle may vary from that shown and have different contours or configurations to suit the hydroforming process. Moreover, when a simulated wood grain finish is required the die halves 74, 76 may be prepared with the pattern incorporated into the die halves 74, 76. Expansion of the tubes 60 within the die therefore embosses the surface of the vinyl with the grain pattern to provide a realistic simulation.

In a spindle having a nominal 32 mm (1¼ inch) square cross section for the base 34 and an overall length for each spindle of 39 inches it was found that a tube of 25 mm (1 inch) diameter was appropriate. The tube material was a Dofasco cold roll SAE 1008/1010 type grade having a wall thickness of 1.5 millimeters. Similarly galvanite or galvaneal tubes can be used. In a computer simulation of the forming operation this was shown to have a safety factor during forming of in excess of 10%.

To facilitate hydroforming, the minimal radius permitted on the profile of the spindle was 2t, where t is the wall thickness with the minimum safety margin occurring at the corner areas of the base 34. By orientating the weld 46 away from the comers into a zone of higher safety margins, splitting of the weld is avoided. Ideally designs should include minimal radiuses of between 3t and 4t although radiuses as small as 2t can be formed.

The computer simulation showed hydroforming to be practical with a pressure of 5000 psi 18,000 psi. Hydroforming was also facilitated by end feeding the tube 60 during forming by applying an axial force to opposite ends of the tube 60 after initial pressurization. In practice it has been found with the 25 mm (1 inch) tube a total end feed in the order of 40 millimeters with a force of 181 KN provides satisfactory expansion for the profile shown in FIG. 2. The wall thickness may vary from 1 to 2.5 millimeters depending upon the profile and nominal diameter of the spindle to be formed. Where small features are incorporated in the spindle 36, the tubes 60 may be pressurized to a relatively high pressure after initial expansion to ensure good conformity with the mold.

The form core is preferably polyurethane foam having a density in the order of 2.5 pounds per cubic foot to give a feel similar to that encountered with a wooden spindle. Foam densities of between 1.0 and 7 $lb/ft^3$ may be used. The core 24 may be foamed in situ or may be inserted as a preformed plug with additional foam added in liquid form to fill the gaps.

Typically the connectors 44 will extend in the order of 2 inches axially along the inside of the spindle body from each end thereby allowing trimming of the spindle and attachment to the rails with conventional carpentry procedures.

Figure 7:
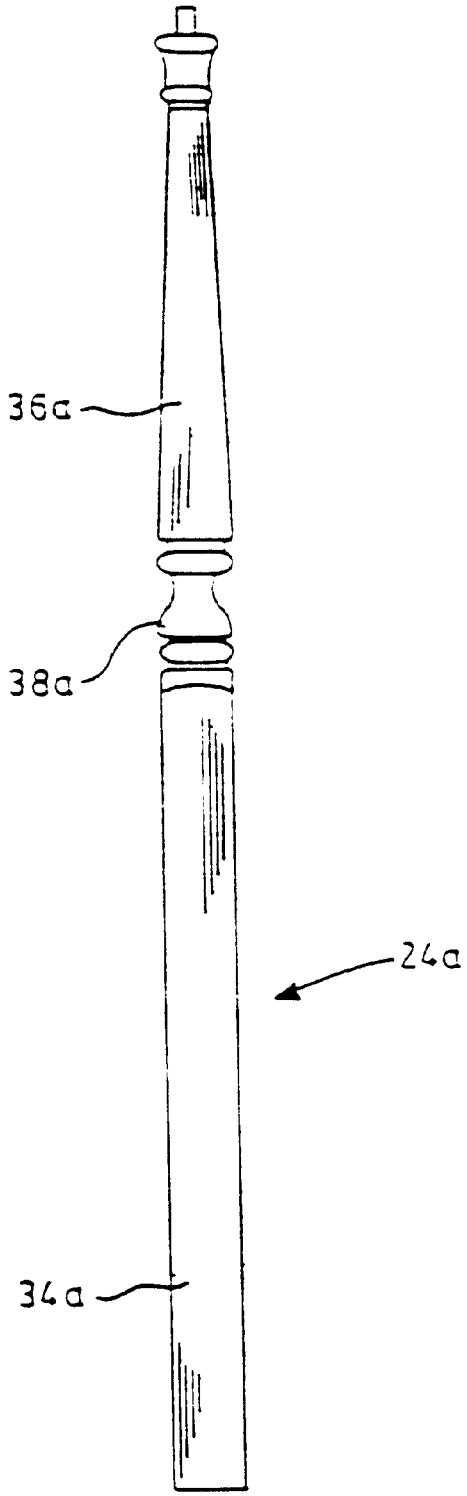
FIG. 7 is a view of a newel post used in the stair construction of FIG. 1
Figure 8:
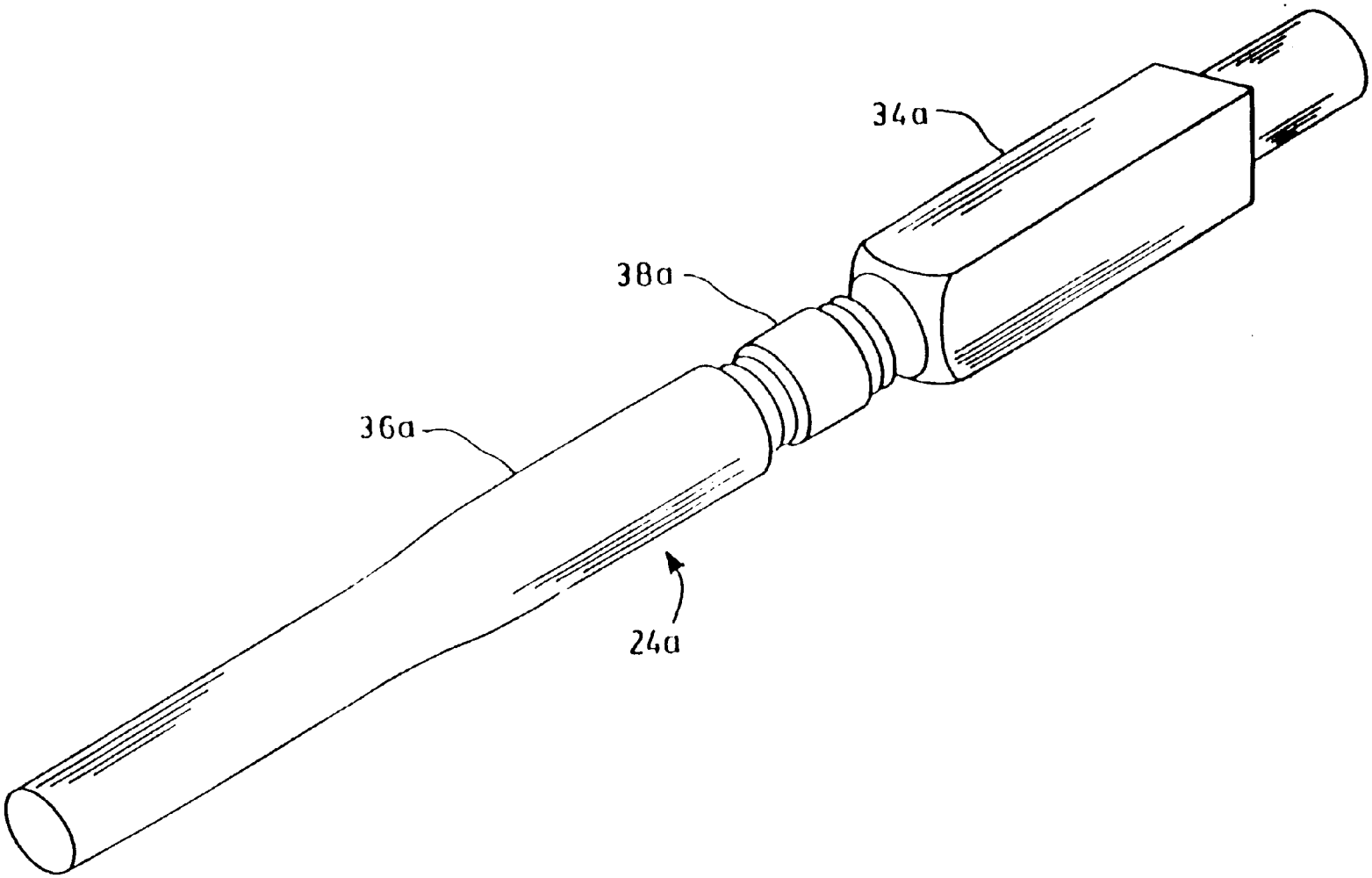
FIG. 8 is a view similar to FIG. 7 of an alternative embodiment of newel post.

The process shown in FIG. 5 may also be utilized to form newel posts 24 as shown in FIGS. 7 and 8. The newel posts will typically have an outer diameter of between 3 and 3 and ½ inches (75–87.5 mm) and in this case a tube 60 of nominal diameter of 2 inches (50 mm) and a wall thickness of between 1 and 3.5 millimeters may be used. Again, as shown in FIG. 7, the newel posts may be formed to a variety of patterns including a rectangular base 34*a* tapered upper portion 36*a* and contoured central portions 38*a*. The posts will typically be in the order of 42 inches to 58 inches long. The connectors 44 may extend further into the posts, i.e. in the order of 4 inches (100 mm) to reflect the additional loads that may be imposed upon the newel posts.

Alternatively, as shown in FIG. 8, the newel post may have a rectangular base 34*a* including four planar facets and contoured central portion 38*a* with a generally cylindrical waisted upper portion 36*a*.

In certain designs of spindle it may be preferable to utilize a diameter of tube 60 that is greater than the minimum diameter of the profile. In this case, the dies halves 74,76 will be configured to crush the tube 60 as they close and therefore provide a localized reduced diameter. Thereafter the tube may be expanded by application of the pressure as described above. Alternatively, an oval tube cross section may be used on tubes of various cross sections including square, triangular or rectangular.

Figure 9:
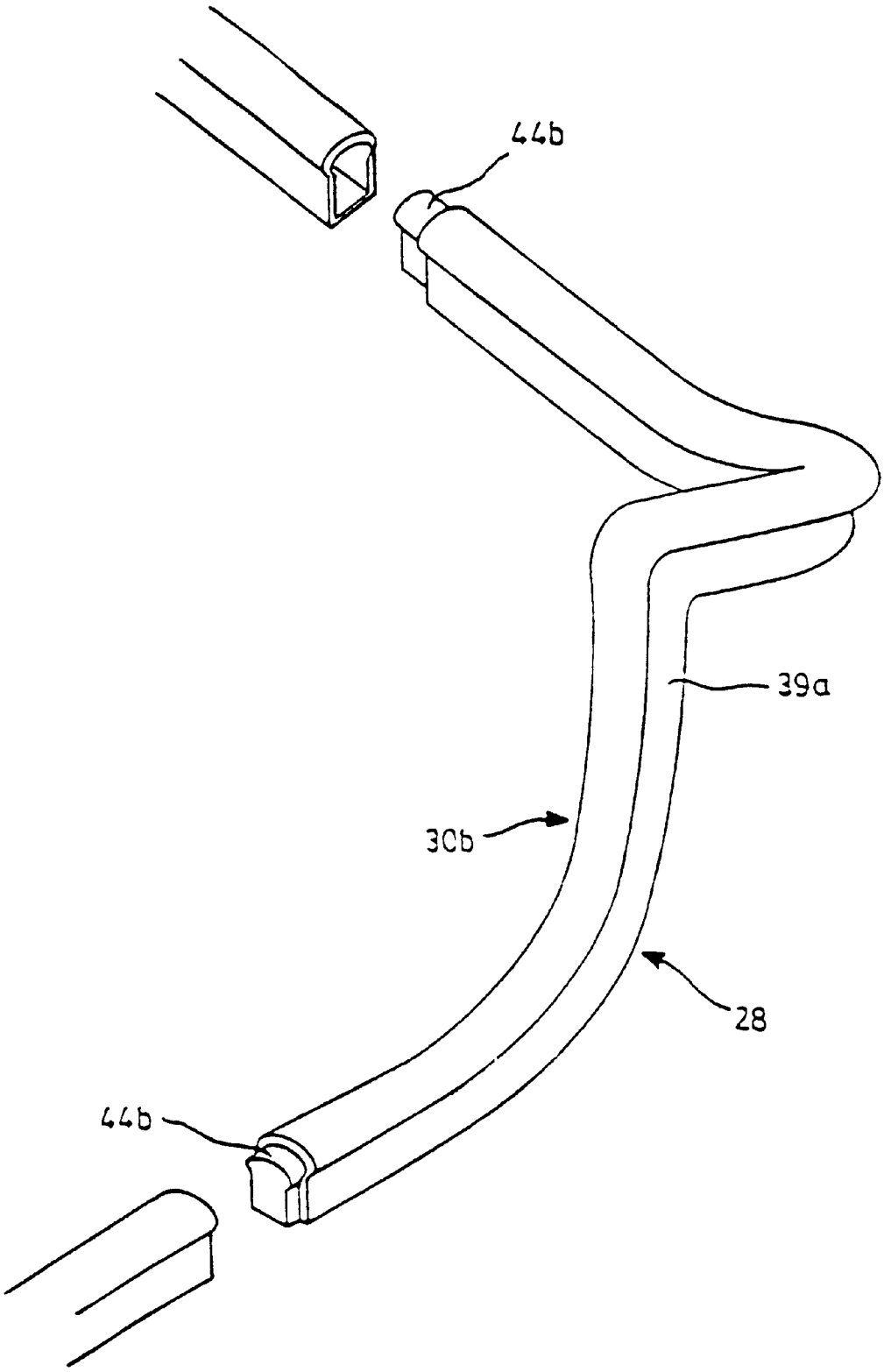
FIG. 9 is a perspective view of a gooseneck shown in the stair construction of FIG. 1.

Similar techniques may also be utilized to form the gooseneck 28 and volute 29 shown in FIG. 1. Like reference numerals will be used to denote like components with a suffix 'b' or 'c' added for clarity. Referring therefore to FIG. 9, the gooseneck 28 is formed from a tubular body 30*b* with vinyl coating and foam core as described above. In order to form the gooseneck 28 shown in FIG. 9, a tube 60*b* is pre-bent to conform generally to the desired shape of the gooseneck 28. Thereafter the pre-bent form is inserted into the die halves 74*b*, 76*b* where it is expanded into the finished form. Connector 44*b* are inverted into the finished form for connection to the linear handrails that may be extruded or rolled as preferred.

Figure 10:
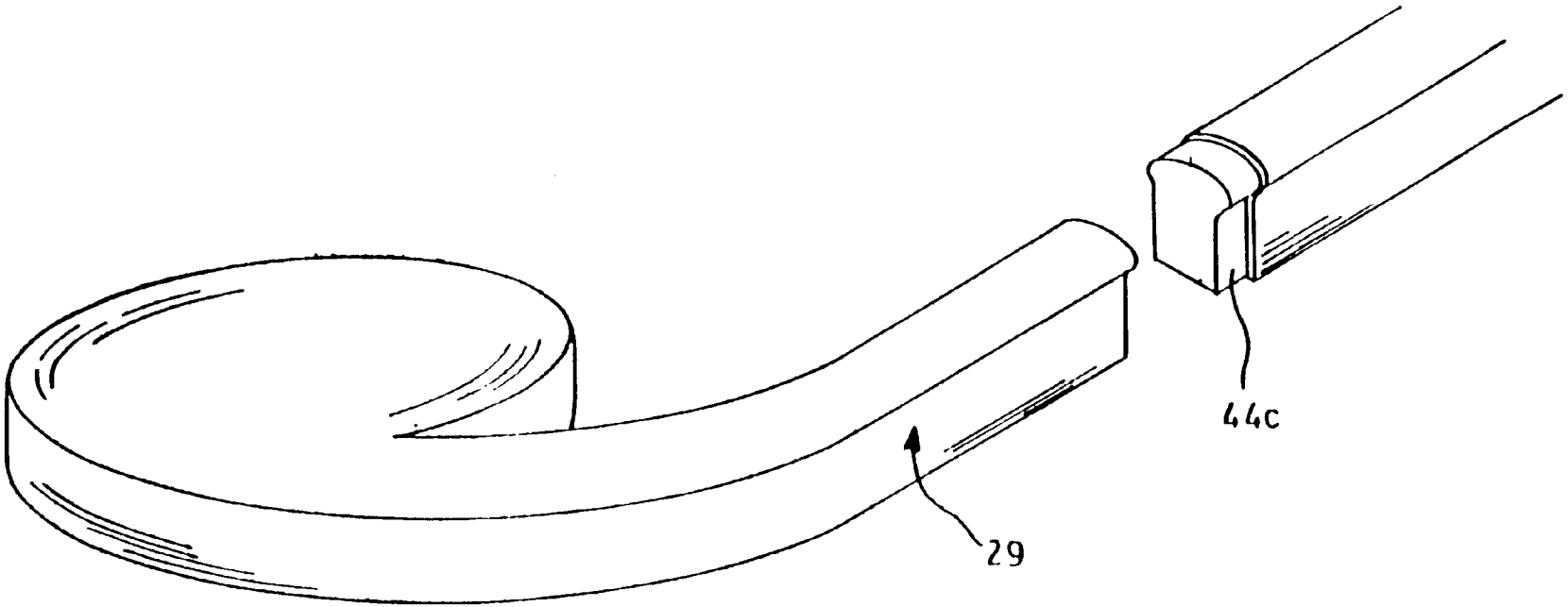
FIG. 10 is a perspective view of a volute used in the stair assembly of FIG. 1.

The hydroforming process may also be utilized to produce the volute 29 shown in FIG. 10 by utilizing a closed end tubular member which is then expanded within the die to form the finished shape. Again the hollow body permits connection through connectors 44*c* to the adjacent rail.

In each of the above cases it will be seen that a railing component may be formed utilizing the hydroforming process to simulate the profile of conventional wooden components. The application of the vinyl coating provides a finish suitable for painting and may be embossed with wood grain if preferred. The relatively thin wall utilized in the tubes provides a component of similar weight and rigidity to that normally encountered with wooden components and the connectors 44 permit use of conventional assembly techniques with other components of the railing system. The foam core provides a feel and sound similar to that normally encountered with wooden components.

It will be appreciated that alternative forms of connectors 44 may be used. For example threaded studs may be provided at either end of the tube or a simple bracket welded or adhered to the walls of the tube after forming. It is however believed that the provision of the wooden plugs is preferred to permit conventional carpentry techniques to be used.

As noted above, the wood grain pattern may be embossed on the vinyl coating during the forming process. If preferred however the vinyl embossing may be applied at a subsequent stamping stop in which the spindles are inserted into a second set of dies for application of the grain embossment. It will also be appreciated that it is possible to apply the plastic film as a heat shrinkable sleeve that is applied to the spindle after forming and shrunk in situ.

As a further alternative the wood grain embossment may be applied to the tube 60 during the tube rolling process. In this case, the embossment can be roll patterned into the steel in one of the final sizing stands of the tube mill. In case the coating will follow the "grain" pattern to give a simulated finish to the spindle.

What is claimed is:

1. A railing component having two opposite ends, said railing component having a unitary tubular metal body having a wall extending between said opposite ends and having a substantially uniform wall thickness and said tubular metal body varying in exterior cross section between said opposite ends wherein said tubular metal wall has a weld seam extending axially between said ends.

2. A railing component according to claim 1 wherein a foam core is provided within said tubular metal wall.

3. A railing component according to claim 1 wherein a connector is provided at at least one end.

4. A railing component according to claim 1 wherein an outer surface of said tubular metal wall is ornamented.

5. A railing component according to claim 4 wherein said ornamentation is embossed in said outer wall.

6. A railing component according to claim 4 wherein said ornamentation is applied to said outer wall.

7. A railing component according to claim 1 wherein said tubular metal wall includes a plurality of interconnected planar facets and said seam is disposed in one of said facets.

8. A railing component according to claim 1 wherein said wall thickness is between 0.5 mm and 2.0 mm.

9. A railing component according to claim 8 wherein said wall thickness is 1.5 mm.

10. A railing component according to claim 8 wherein said tubular wall is contoured and has a minimal radius of not less than 2.5 mm.

11. A railing component according to claim 1 wherein said tubular metal wall includes a fold line extending axially between a pair of adjacent surfaces, said weld seam is disposed adjacent to said fold line and within one of said pair of adjacent surfaces.

12. A railing component having two opposite ends, said railing component having a unitary tubular metal body having a wall extending between said opposite ends and having a substantially uniform wall thickness and said tubular metal body varying in exterior cross section between said opposite ends wherein a connector is provided at at least one end and wherein said connector includes a wooden plug inserted within said tubular body.

13. A railing component having two opposite ends, said railing component having a unitary tubular metal body having a wall extending between said opposite ends and having a substantially uniform wall thickness and said tubular metal body varying in exterior cross section between said opposite ends wherein an outer surface of said tubular metal wall is ornamented and said ornamentation is applied by a film encompassing said tubular metal wall.

14. A railing component according to claim 13 wherein said film is a sleeve of heat shrinkable plastics material.

15. A railing component according to claim 13 wherein said film is a vinyl polymer.

16. A railing component having two opposite ends, said railing component having a unitary tubular metal body having a wall extending between said opposite ends and having a substantially uniform wall thickness and said tubular metal body varying in exterior cross section between said ends, a core within said tubular body in engagement with at least a portion of said tubular wall, and a pair of connectors at said opposite ends wherein a coating is applied to an exterior surface of said tubular body.

17. A railing component according to claim 16 wherein said connectors extend partially along said body from said opposite ends.

18. A railing component according to claim 16 wherein said coating is a plastics material.

19. A railing component according to claim 18 wherein said plastics material is a vinyl polymer.

20. A railing component according to claim 16 wherein a pattern is applied to said coating.

21. A railing component according to claim 20 wherein said pattern is embossed on said coating by application of an external force thereto.

22. A railing component according to claim 21 wherein said pattern is applied to said tubular body and said coating conforms thereto.

23. A railing component according to claim 16 wherein said tubular body has an externally contoured surface and contours on said surface have a radius of not less than twice the thickness of the tubular wall.

24. A railing component according to claim 23 wherein said tubular wall has a thickness of between 0.5 mm and 2.0 mm.

25. A railing component according to claim 24 wherein said wall thickness is 1.5 mm.

26. A railing component according to claim 23 wherein said body includes a tapered upper portion and a base having a plurality of planar facets.

27. A railing component according to claim 26 wherein said tubular wall has an axially extending weld located within one of said planar facets.

28. A railing component according to claim 26 wherein said upper tapered portion and base portion are interconnected by a contoured central portion.

29. A railing component having two opposite ends, said railing component having a unitary tubular metal body having a wall extending between said opposite ends and having a substantially uniform wall thickness and said tubular metal body varying in exterior cross section between said ends, a core within said tubular body in engagement with at least a portion of said tubular wall, and a pair of connectors at said opposite ends wherein said connectors extend partially along said body from said opposite ends and said connectors are plugs engageable with said tubular wall and overlapping a portion thereof.

30. A railing component according to claim 29 wherein said plugs are wood.

31. A railing component according to claim 30 wherein said plugs are an interference fit in said tubular metal body.

32. A railing component having two opposite ends, said railing component comprising a tubular metal body having a wall extending between said opposite ends of said component and having a substantially uniform wall thickness, said tubular body varying in exterior cross section between said opposite ends, the tubular body having an externally contoured surface including a plurality of connected adjacent surfaces, the tubular wall having an axially extending weld located within on of the adjacent surfaces.

* * * * *